United States Patent [19]

Shimizu

[11] Patent Number: 4,561,832

[45] Date of Patent: Dec. 31, 1985

[54] LUBRICATING MECHANISM FOR A SCROLL-TYPE FLUID DISPLACEMENT APPARATUS

[75] Inventor: Shigemi Shimizu, Gunma, Japan

[73] Assignee: Sanden Corporation, Gunma, Japan

[21] Appl. No.: 586,968

[22] Filed: Mar. 7, 1984

[30] Foreign Application Priority Data

Mar. 14, 1983 [JP] Japan ..... 58-35404[U]

[51] Int. Cl.[4] ..... F01C 1/04; F01C 21/04; F01C 19/00

[52] U.S. Cl. ..... 418/55; 418/97; 418/142

[58] Field of Search ..... 418/55, 97, 144, 142

[56] References Cited

U.S. PATENT DOCUMENTS

| | | | |
|---|---|---|---|
| 801,182 | 10/1906 | Creux . | |
| 3,924,977 | 12/1975 | McCullough | 418/55 |
| 3,994,633 | 11/1976 | Shaffer . | |
| 3,994,635 | 11/1976 | McCullough | 418/55 |
| 4,303,379 | 12/1981 | Hiraga et al. . | |

FOREIGN PATENT DOCUMENTS

| | | | |
|---|---|---|---|
| 0012614 | 6/1980 | European Pat. Off. | 418/55 |
| 0065261 | 11/1982 | European Pat. Off. | 418/55 |
| 56-156490 | 12/1981 | Japan | 418/55 |

*Primary Examiner*—John J. Vrablik
*Assistant Examiner*—Theodore Olds
*Attorney, Agent, or Firm*—Banner, Birch, McKie & Beckett

[57] ABSTRACT

A scroll-type fluid displacement apparatus with a lubricating mechanism to lubricate between an end plate and an opposed spiral wrap is disclosed. The apparatus has a pair of scrolls, each of which comprises a circular end plate and a spiral wrap extending from one side of the end plate. A groove, in which a seal element is loosely fitted, is formed on the axial end surface of each spiral wrap. One spiral wrap has a second groove at its axial end surface and extends close to the outer terminal end of spiral wrap. The sectional shape of the second groove is different from the sectional shape of the first groove to prevent the movement of the seal element in the first groove. Gas containing lubricating oil is supplied to the outer terminal portion of spiral wrap through the first groove and second grooves.

4 Claims, 4 Drawing Figures

LUBRICATING MECHANISM FOR A SCROLL-TYPE FLUID DISPLACEMENT APPARATUS

TECHNICAL FIELD

This invention relates to a fluid displacement apparatus, and more particularly, to a fluid displacement apparatus having an improved lubricating mechanism between a spiral element and an opposed end plate.

BACKGROUND OF THE INVENTION

Scroll-type fluid displacement apparatus are well known in the prior art. For example, U.S. Pat. No. 801,182 (Creux) discloses the basic construction of a scroll-type fluid displacement apparatus which includes two scroll members, each having a circular end plate and a spiroidal or involute spiral element. These scroll members are maintained angularly and radially offset so that both spiral elements interfit to make a plurality of line contacts between their spiral curved surfaces to thereby seal off and define at least one pair of fluid pockets. The relative orbital motion of the two scroll members shifts the line contacts along the spiral curved surfaces and, therefore, the fluid pockets change in volume. Since the volume of sealed off fluid pockets increases or decreases depending on the direction of the orbiting motion, the scroll-type fluid displacement apparatus is applicable to compress, expand or pump fluids.

In comparison with a conventional compressors of the piston type, a scroll-type compressor has certain advantages, such as fewer parts and continuous compression of fluid. However, one of the problems encountered in prior art scroll-type compressors has been ineffective sealing of the fluid pockets. Axial and radial sealing of the fluid pockets must be maintained in a scroll-type compressor in order to achieve efficient operation. The fluid pockets in the scroll-type compressor are defined by line contacts between the interfitting spiral elements and axial contacts between the axial end surface of the spiral elements and the inner surface of the end plates.

One prior art solution to the radial sealing problem is described in copending application Ser. No. 244,961, filed on Mar. 18, 1981. This application discloses an orbiting scroll rotatably supported on a crank pin through a bushing wherein the axis of the crank pin is radially offset or eccentric to the axis of the drive shaft. During operation of the apparatus, radial sealing is effected by the orbiting scroll being pushed against the fixed scroll due to the moment created by the differential between the driving point and reaction force acting point.

Furthermore, various techniques have been used in the prior art to resolve the sealing problem, particularly the axial sealing problem. For example, U.S. Pat. No. 3,994,635 (McCullough) discloses a scroll-type fluid displacement apparatus wherein the end surface of each spiral element facing the end plate of the other scroll member includes a groove formed along the spiral. A seal element is loosely fitted within the groove and an axially force urging device, such as a spring, is placed behind the seal element to urge the seal element toward the facing end surface of the end plate to thereby effect axial sealing.

In this construction of axial sealing mechanism, the contacting surface between inner end surface of end plate and the axial end surface of spiral element, i.e., end surface of seal element, is lubricated by lubricating oil contained in the gas which is taken into the fluid pockets. The lubricating oil flows along the groove with the gas because of the pressure difference between the areas adjacent outer end of the spiral element and the center of the spiral element.

However, this solution would not work satisfactorily in a scroll-type fluid displacement apparatus such as is shown in U.S. Pat. No. 4,303,379, wherein the radius of orbiting end plate is formed smaller than the radius of fixed end plate to reduce the diameter of compressor casing while keeping the same displacement capacity. In this apparatus the outer terminal portion of fixed spiral element can move out of contact with opposed orbiting end plate. The seal element in the groove of fixed spiral element therefore cannot extend along the entire length of the spiral element because the outer portion of seal element may interfere with the edge of orbiting end plate. Thus, the contact portion between inner end surface of the orbiting end plate and the outer terminal end portion of the fixed spiral element, in which a seal element is not disposed, is not lubricated by oil or gas. Interference between the end plate and outer terminal portion of spiral element may occur due to insufficient lubricating oil, thereby causing abnormal wear.

SUMMARY OF THE INVENTION

It is a primary object of this invention to provide an improved scroll-type fluid displacement apparatus with a high efficiency lubricating mechanism.

It is another object of this invention to provide a scroll-type fluid displacement apparatus wherein abnormal wear of the end plate and spiral element is prevented, thus enhancing axial sealing of the fluid pockets.

It is still another object of this invention to provide a scroll-type fluid displacement apparatus which is simple to construct and manufacture, yet achieves the above objects.

A scroll-type fluid displacement apparatus according to this invention includes a pair of scrolls, each comprising a circular end plate and a spiral wrap extending from one side of the circular end plate. A groove is formed in the axial end surface of each spiral wrap and extends along the spiral curve of the wrap. A seal element is loosely fitted in the groove to achieve the axial sealing between the inner end surface of an end plate and the axial end surface of an opposed spiral wrap. A second groove is formed in the axial end surface of one spiral wrap as an extension of the first groove, and extends close to the outer terminal end of the one spiral wrap. The cross-sectional shape of the second groove is different from that of the first groove to prevent movement of the seal element carried in the first groove.

Further objects, features and aspects of this invention will be understood from the following detailed description of a preferred embodiment of this invention with reference to the annexed drawings.

DETAILED DESCRIPTION OF THE INVENTION

Figure 1:
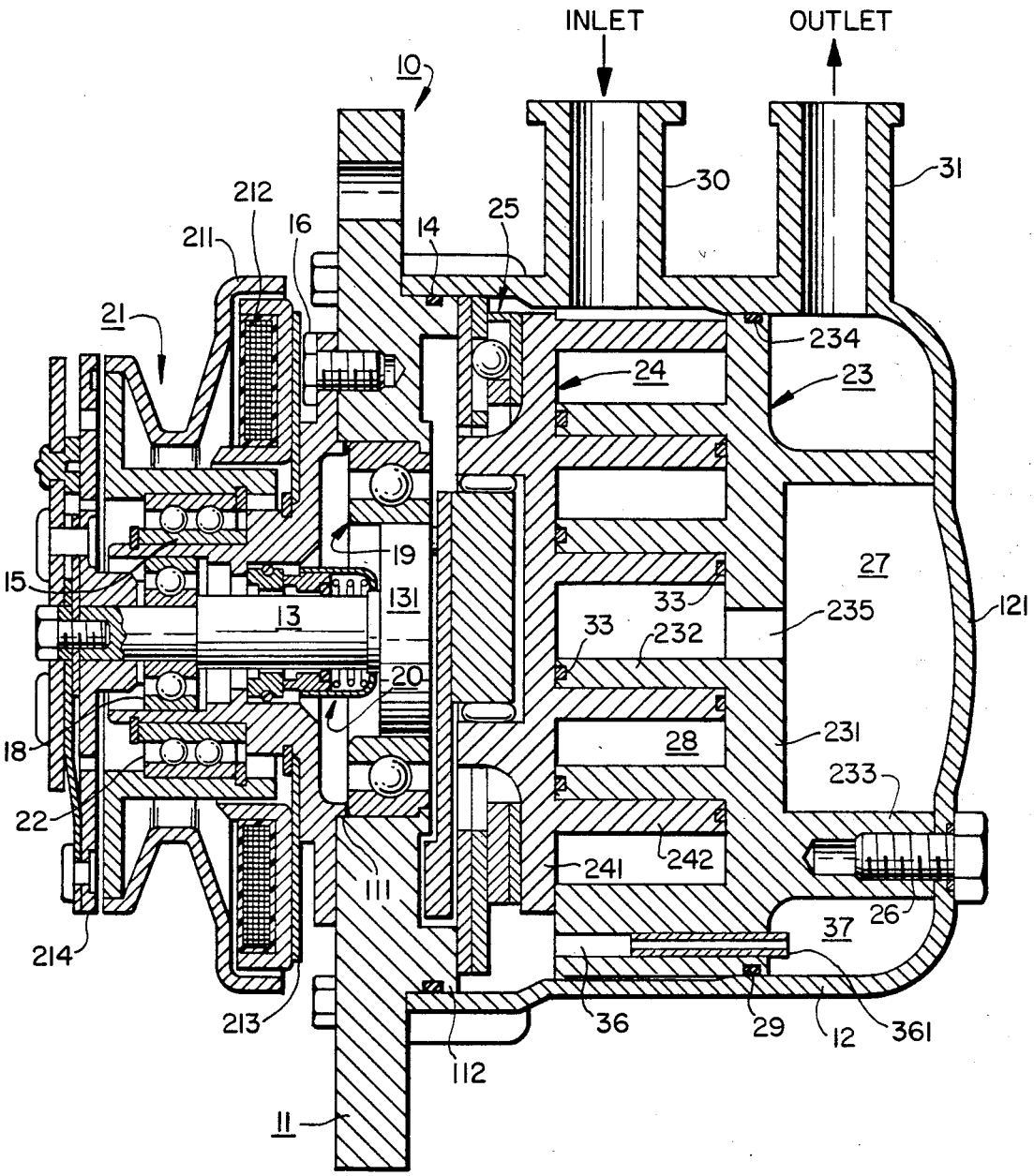
FIG. 1 is a vertical sectional view of a compressor type of fluid displacement apparatus according to an embodiment of this invention.

Referring to FIG. 1, a fluid displacement apparatus, a scroll-type compressor, in accordance with the present invention, is shown. The compressor includes a compressor housing 10 having a front end plate 11 and a cup-shaped casing 12 fastened to an end surface of end plate 11. An opening 111 is formed in the center of front end plate 11 for supporting a drive shaft 13. An annular projection 112, concentric with opening 111, is formed on the rear end surface of front end plate 11 facing cup-shaped casing 12. An outer peripheral surface of annular projection 112 fits into an inner wall of the opening of cup-shaped casing 12. Cup-shaped casing 12 is fixed on the rear end surface of front end plate 11 by a fastening device so that the opening of cup-shaped casing 12 is covered by front end plate 11. An O-ring 14 is placed between the outer peripheral surface of annular projection 112 and the inner wall of cup-shaped casing 12. Front end plate 11 has an annular sleeve 15 projecting from its front end surface. This sleeve 15 surrounds drive shaft 13 to define a shaft seal cavity. As shown in FIG. 1, sleeve 15 is attached to the front end surface of front end plate 11 by screws 16, one of which is shown in FIG. 1. Alternatively, sleeve 15 may be formed integral with front end plate 11.

Drive shaft 13 is rotatably supported by sleeve 15 through a bearing 18 disposed within the front end of sleeve 15. Drive shaft 13 has a disk-shaped rotor 131 at its inner end, which is rotatably supported by front end plate 11 through a bearing 19 disposed within opening 111 of front end plate 11. A shaft seal assembly 20 is assembled on drive shaft 13 within the shaft seal cavity of sleeve 15.

A pulley 211 is rotatably supported by a bearing 22 on the outer surface of sleeve 15. An electro-magnetic coil 212, which is received in an annular cavity of pulley 211, and is mounted on the outer surface of sleeve 15 by a support plate 213. An armature plate 214 is elastically supported on the outer end of drive shaft 13 which extends from sleeve 15. A magnetic clutch 21 is formed by pulley 211, electro-magnetic coil 212 and armature plate 214. Thus, drive shaft 13 is driven by an external power source, for example, an engine of a vehicle, through a rotation transmitting device, such as the above-described magnetic clutch.

A number of elements are located within the inner chamber of cup-shaped casing 12 including a fixed scroll 23, an orbiting scroll 24, a driving mechanism for orbiting scroll 24 and a rotation preventing-thrust bearing device 25 for orbiting scroll 24. The inner chamber of cup-shaped casing 12 is formed between the inner wall of cup-shaped casing 12 and front end plate 11.

Fixed scroll 23 includes a circular end plate 231, a wrap or spiral element 232 affixed to or extending from one end surface of end plate 231, and a plurality of internal bosses 233 axially projecting from the end surface of circular end plate 231 on the side opposite spiral element 232. The end surface of each boss 233 is seated on the inner surface of end plate portion 121 of casing 12 by a plurality of bolts 26, one of which is shown in FIG. 1. Hence, fixed scroll 23 is fixedly disposed within cup-shaped casing 12. Circular end plate 231 of fixed scroll 23 partitions the inner chamber of cup-shaped casing 12 into a rear chamber 27 having bosses 233, and a front chamber 28, in which spiral element 232 of fixed scroll 23 is located. A sealing member 29 is disposed within a circumferential groove 234 of circular end plate 231 for sealing the outer peripheral surface of circular end plate 231 and the inner wall of cup-shaped casing 12. A hole or discharge port 235 is formed through circular end plate 231 at a position near the center of spiral element 232 to connect the fluid pocket at the center of spiral element 232 with rear chamber 27.

Orbiting scroll 24, which is disposed in front chamber 28, includes a circular end plate 241 and a wrap or spiral element 242 affixed to or extending from one end surface of circular end plate 241. The spiral elements 242 and 232 interfit at an angular offset of 180° and a predetermined radial offset. The spiral elements define at least a pair of fluid pockets between their interfitting surfaces. Orbiting scroll 24 is connected to the driving mechanism and the rotation preventing/thrust bearing device 25. The driving mechanism and rotation preventing/thrust bearing device 25 effect orbital motion of orbiting scroll 24 by the rotation of drive shaft 13 to thereby compress fluid passing through the compressor.

As described in U.S. Pat. No. 4,303,379, the diameter of end plate 241 of orbiting scroll 24 is smaller than the diameter of end plate 231 of fixed scroll 23. Therefore, the seal element carried by the orbiting scroll can extend along the entire length of spiral element 242; however, the seal element carried by the fixed scroll 23 cannot extend along the entire length of spiral element 232 because the outer portion of spiral element 232 is out of contact with end plate 241 of orbiting scroll 24 during a portion of its motion.

As orbiting scroll 24 orbits, the line contacts between spiral elements 232 and 242 shift toward the center of the spiral elements along their respective surfaces. The fluid pockets defined by the line contacts of spiral elements 232 and 242 move toward the center with a consequent reduction of volume, to thereby compress the fluid in the fluid pockets. Therefore, fluid or refrigerant gas introduced into front chamber 28 from an external fluid circuit through an inlet port 30 mounted on the outside of cup-shaped casing 12 is taken into the fluid pockets formed at the outer portion of spiral elements 232 and 242. As orbiting scroll 24 orbits, the fluid is compressed as the pockets move toward the center of the spiral element. Finally, the compressed fluid is discharged into rear chamber 27 through hole 235, and thereafter, the fluid is discharged to the external fluid circuit through an outlet port 31 formed on cup-shaped casing 12.

Figure 2:
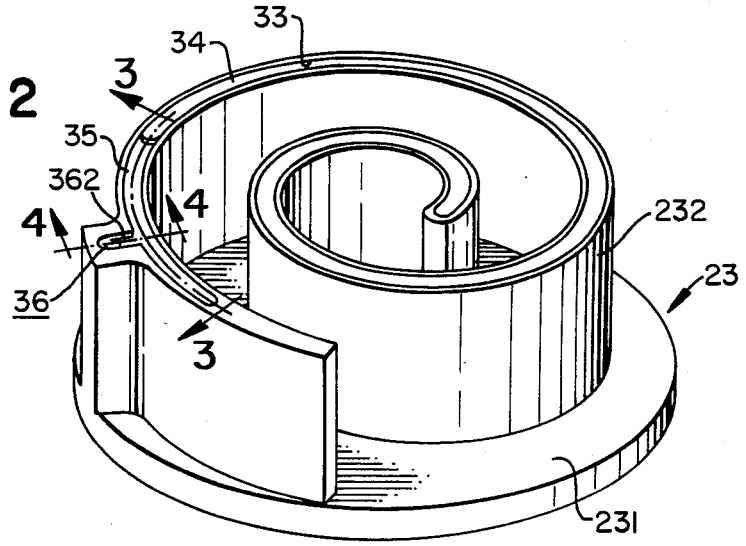
FIG. 2 is a perspective view of the fixed scroll illustrated in FIG. 1.
Figure 3:
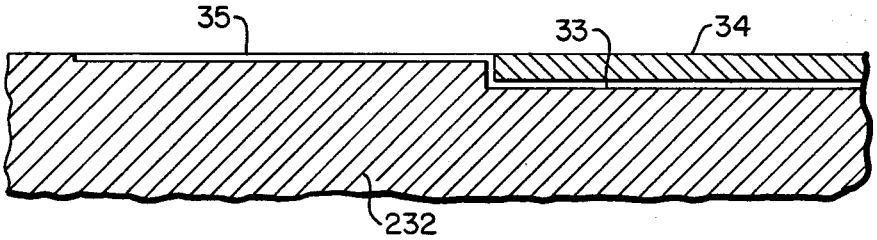
FIG. 3 is a sectional view taken along line III—III in FIG. 2.

Referring to FIGS. 2 and 3, spiral element 232 of fixed scroll 23 is provided with a groove 33 formed in its axial end surface along the spiral curve of the spiral element. Groove 33 extends from the inner end portion of the spiral element to a position close to the position on the spiral element which is usually in contact with the opposed end plate. A seal element 34 is loosely fitted within groove 33. In this construction, an additional groove 35 is formed on the axial end surface of spiral element 232 as an extension from the outer end position of groove 33, and extends close to the outer terminal end of spiral element 232. As shown in FIG. 3, the depth of additional groove 35 is shallower than the depth of groove 33 so that the movement of seal element 34 toward the radially outward area is prevented. Alternatively, the width of additional groove 35 may be formed smaller than the width of groove 33 to likewise prevent the motion of seal element 34.

As mentioned above, additional groove 35 is formed on the axial end surface of spiral element 232, is connected to groove 33 and extends close to the outer terminal end of spiral element 232. Thus, the refrigerant, including the lubricating oil, flows along groove 33 and additional groove 35 by the pressure difference between the center portion of the spiral elements and their outer portion. During flow of refrigerant gas, the contact surface between the end surface of the seal element and the inner end surface of the end plate is lubricated by the lubrication oil contained in the refrigerant gas. The contacting surface between the axial end surface of the outer end portion of spiral element 232 and the inner end surface of opposed end plate 241 is also lubricated by the lubrication oil which flows along additional groove 35 with the refrigerant gas. Therefore, abnormal contact between the axial end surface of the outer end portion of spiral element 232 and opposed end plate 242 is prevented.

Figure 4:
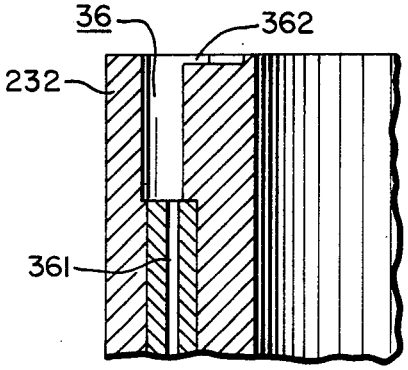
FIG. 4 is a sectional view taken along line IV—IV in FIG. 2.

FIG. 4 shows in detail an optional feature of the present invention wherein an oil passageway 36, including an orifice 361, is formed in the lower portion of fixed scroll 23. As shown in FIGS. 1, 2 or 4, one end opening of passageway 36 faces orbiting scroll 24 and is connected with additional groove 35 through a sub-passageway 362 formed on the axial end surface of spiral element 232. Therefore, lubricating oil accumulated in an oil sump 37, which is formed in a lower portion of rear chamber 27, can be supplied to additional groove 35 through oil passageway 36 and used as the lubricating oil to lubricate between end plate 241 and spiral element 232.

This invention has been described in detail in connection with a preferred embodiment, including an optional feature, but this is for example only and this invention is not restricted thereto. It will be easily understood by those skilled in the art that variations and modifications can be easily made without departing from the scope of this invention.

I claim:

1. In a scroll-type fluid displacement apparatus including a pair of scrolls, each comprising a circular end plate and a spiral wrap extending from one side of said end plate, said spiral wrap having a first groove formed in the axial end surface thereof along the spiral curve, a seal element carried in said first groove, said spiral wraps interfitting at an angular and radial offset to make a plurality of line contacts which define at least one pair of sealed off fluid pockets, driving means operatively connected to one of said scrolls for orbiting said one scroll relative to other scroll and for preventing rotation of said one scroll to change the volume of the fluid pockets, the improvement comprising a second groove formed in the axial end surface of one of said spiral wraps in communication with said first groove, said second groove extending close to the outer terminal end of said one spiral wrap, said axial end surface of one of said spiral wraps having said second groove forming a contact surface for contacting the circular end plate of the opposing scroll and said second groove supplying lubricating oil to said contact surface, and the cross-sectional shape of said second groove being different from the cross-sectional shape of said first groove to prevent the movement of said seal element in said first groove.

2. The scroll-type fluid displacement apparatus of claim 1 wherein the depth of said second groove is shallower than the depth of said first groove.

3. The scroll-type fluid displacement apparatus of claim 1 wherein the width of said second groove is narrower than the width of said first groove.

4. The scroll-type fluid displacement apparatus of claim 1 further comprising an oil passageway formed through the spiral wrap of one of said scrolls and communicating with an oil sump, and a connecting groove formed on the axial end surface of said one spiral wrap to communicate between said second groove and said oil passageway.

* * * * *